US011585503B2

(12) United States Patent
Chiang

(10) Patent No.: US 11,585,503 B2
(45) Date of Patent: Feb. 21, 2023

(54) STREET LIGHT

(71) Applicant: Agileiots Investment Co., Ltd., Taoyuan (TW)

(72) Inventor: Hung-Hsiang Chiang, Kaohsiung (TW)

(73) Assignee: AGILEIOTS INVESTMENT CO., LTD., Taoyuan (TW)

( * ) Notice: Subject to any disclaimer, the term of this patent is extended or adjusted under 35 U.S.C. 154(b) by 0 days.

(21) Appl. No.: 17/523,912

(22) Filed: Nov. 11, 2021

(65) Prior Publication Data

US 2022/0146065 A1 May 12, 2022

(30) Foreign Application Priority Data

Nov. 11, 2020 (TW) ..... 109139405

(51) Int. Cl.

| | |
|---|---|
| ***F21S 8/08*** | (2006.01) |
| ***H01Q 1/12*** | (2006.01) |
| ***F21V 29/60*** | (2015.01) |
| ***F21V 31/03*** | (2006.01) |
| *F21W 131/103* | (2006.01) |

(52) U.S. Cl.

CPC ..... *F21S 8/086* (2013.01); *F21V 29/60* (2015.01); *F21V 31/03* (2013.01); *H01Q 1/1264* (2013.01); *F21W 2131/103* (2013.01)

(58) Field of Classification Search

CPC ..... F21S 8/086; F21V 31/03; F21V 28/60

See application file for complete search history.

(56) References Cited

U.S. PATENT DOCUMENTS

| | | | | |
|---|---|---|---|---|
| 8,123,378 | B1 * | 2/2012 | Ruberg | F21S 8/088 362/249.02 |
| 11,262,037 | B2 * | 3/2022 | Bijl | F21S 8/088 |
| 2009/0040750 | A1 * | 2/2009 | Myer | F21S 9/037 136/246 |
| 2009/0262525 | A1 * | 10/2009 | Lai | F21S 9/03 320/101 |
| 2010/0073921 | A1 * | 3/2010 | Zhou | F03G 6/00 362/192 |
| 2011/0058368 | A1 * | 3/2011 | Shiau | F21K 9/65 362/225 |

* cited by examiner

*Primary Examiner* — Julie A Bannan

(74) *Attorney, Agent, or Firm* — Chun-Ming Shih; Lanway IPR Services

(57) ABSTRACT

A street light allows an electronic device installed therein to work properly. The street light has an internal chimney structure for dissipating heat from the electronic device and preventing any liquid from flowing into a space where the electronic device is accommodated. This allows the street light to internally provide both a dry environment and a heat dissipation mechanism for the electronic device, without closing an internal space of the street light, so as to greatly improve the above undesirable structural drawbacks of the conventional street light.

16 Claims, 10 Drawing Sheets

STREET LIGHT

CROSS-REFERENCE TO RELATED APPLICATIONS

This application claims the priority of Republic of China Patent Application No. 109139405 filed on Nov. 11, 2020, in the State Intellectual Property Office of the R.O.C., the disclosure of which is incorporated herein by reference.

BACKGROUND OF THE INVENTION

Field of the Invention

The present invention relates to a street light, and more particularly, to a street light with an internal chimney structure.

Descriptions of the Related Art

Street lights are common lighting equipment used in urban areas, and are advantageously widely spread and evenly distributed. There has been forming a trend of installing various electronic equipment in the street lights for future smart city development. In order to allow stable long-term operation of the electronic equipment in a street light, a dry environment and a heat dissipation mechanism inside the street light should usually be provided for the electronic equipment. An existing street light is formed with an enclosed internal space that is used as the dry operating environment for the electronic equipment. Such an enclosed space, however, adversely affects heat convection and causes heat produced by operation of the electronic equipment unable to be effectively discharged. This shows the existing street light fails to provide an effective heat dissipation mechanism for the electronic equipment operating inside it. It has become a technological difficulty in attempting to make a street light internally have both a dry environment and a heat dissipation mechanism.

Therefore, how to resolve the above structural drawbacks of a conventional street light, in order to provide a dry environment and a heat dissipation mechanism for electronic equipment operating inside the street light, is an important task in the art.

SUMMARY OF THE INVENTION

In view of the above drawbacks in the prior art, the present invention is to provide a street light for allowing a base electronic device to operate therein, for using a cold gas(such as cold air) to dissipate heat from the base electronic device and for removing a liquid inside the street light, the street light including: a light base including a base internal space, a base inlet and a base outlet, wherein the base electronic device is received in the base internal space; a pole including a pole internal space, a pole inlet, a pole outlet and a pole drain; and a chimney structure formed in the pole internal space, and including a chimney internal space, a chimney inlet and a chimney outlet; wherein, the pole inlet is used to introduce the cold gas to the pole internal space; the chimney inlet is used to introduce a part of the cold gas in the pole internal space to the chimney internal space; the base inlet is used to introduce a part of the cold gas in the chimney internal space to the base internal space, allowing the cold gas to absorb heat produced by operation of the base electronic device to form a hot gas(such as hot air); the base outlet is used to discharge a part of the hot gas in the base internal space into the chimney internal space; the chimney outlet is used to discharge a part of the hot gas in the chimney internal space into the pole internal space; the pole outlet is used to discharge a part of the hot gas from the pole internal space to achieve heat dissipation; there is formed a liquid space surrounded by the light base, the pole and the chimney structure to receive the liquid; and the pole drain is connected to the liquid space to remove the liquid received in the liquid space so as to prevent the liquid from entering the base internal space through the chimney structure and affecting operation of the base electronic device.

Preferably, in the street light said above, further including an antenna base detachably mounted on the pole, wherein the antenna base has at least one antenna for sending and receiving wireless signals for use in operation of the base electronic device.

Preferably, in the street light said above, the antenna base has a plurality of antennas separately provided on an imaginary circle with a predetermined central angle interval between any two adjacent ones of the plurality of antennas, wherein the predetermined central angle is substantially 120 degrees or 180 degrees.

Preferably, in the street light said above, the antenna base further includes an antenna base body and a rotation structure, wherein the antenna is mounted at the rotation structure that allows the antenna to rotate in relation to the antenna base body to adjust its direction and position for wireless signal sending and receiving.

Preferably, in the street light said above, the antenna base further includes a cover for covering the antenna.

Preferably, in the street light said above, the cover is made of PTFE or PE for allowing transmission of millimeter-wave wireless signals of the antenna through the cover.

Preferably, in the street light said above, the pole outlet is located substantially higher than the pole inlet, and the chimney outlet is located substantially higher than the chimney inlet.

Preferably, in the street light said above, wherein the pole outlet is located substantially higher than the chimney outlet to receive a part of the hot gas discharged from the chimney outlet.

Preferably, in the street light said above, the base inlet and the base outlet are combined as a single opening, and the chimney inlet and the chimney outlet are combined as a single opening.

Preferably, in the street light said above, the pole inlet is located substantially lower than the chimney inlet or the chimney outlet to prevent the liquid in the liquid space from reaching the chimney inlet or the chimney outlet, so as to stop the liquid entering the base internal space through the chimney internal space and affecting operation of the base electronic device.

Preferably, in the street light said above, the pole drain, the pole inlet and the pole outlet are combined as a single opening.

Preferably, in the street light said above, the light base further includes at least one waterproof connector for providing waterproof protection to prevent the liquid from flowing into the base internal space, and for connecting a pole wire in the pole internal space to a base wire in the base internal space.

Preferably, in the street light said above, further including the guiding structure provided near the chimney inlet, it is used to guide the liquid around the chimney inlet to leave the chimney inlet so as to prevent the liquid from entering the base internal space through the chimney inlet and impairing operation of the base electronic device; wherein with guiding structure provided near the chimney outlet, it is used to guide the liquid around the chimney outlet to leave the chimney outlet so as to prevent the liquid from entering the base internal space through the chimney outlet and impairing operation of the base electronic device.

Preferably, in the street light said above, further including a carrier for carrying the pole electronic device, wherein the carrier is mounted at a predetermined position in the pole internal space by means of the chimney structure.

According to another purpose of the invention, another street light is provided in the invention for allowing a base electronic device to operate therein, for using a cold gas to dissipate heat from the base electronic device and for removing a liquid inside the street light, the street light including: a light base including a base internal space, a base inlet and a base outlet, wherein the base electronic device is received in the base internal space; a pole including a pole internal space, a pole inlet, a pole outlet and a pole drain; and a chimney structure including an inlet chimney sub-structure and an outlet chimney sub-structure, wherein the inlet chimney substructure is provided in the pole internal space, and includes an inlet chimney sub-structure internal space and a chimney inlet; and wherein the outlet chimney sub-structure is provided in the pole internal space, and includes an outlet chimney sub-structure internal space and a chimney outlet; wherein, the pole inlet is used to introduce the cold gas to the pole internal space; the chimney inlet is used to introduce a part of the cold gas in the pole internal space to the inlet chimney sub-structure internal space; the base inlet is used to introduce a part of the cold gas in the inlet chimney sub-structure internal space to the base internal space, allowing the cold gas to absorb heat produced by operation of the base electronic device to form a hot gas; the base outlet is used to discharge a part of the hot gas in the base internal space into the outlet chimney sub-structure internal space; the chimney outlet is used to discharge a part of the hot gas in the outlet chimney sub-structure internal space into the pole internal space; the pole outlet is used to discharge a part of the hot gas from the pole internal space to achieve heat dissipation; there is formed a liquid space surrounded by the light base, the pole, the inlet chimney sub-structure and the outlet chimney sub-structure to receive the liquid; and the pole drain is connected to the liquid space to remove the liquid received in the liquid space so as to prevent the liquid from entering the base internal space through the chimney structure and affecting operation of the base electronic device.

Preferably, in the street light said above, further including a gas thruster provided near the chimney inlet or the chimney outlet; wherein with the gas thruster provided near the chimney inlet, it is used to drive a part of the cold gas in the pole internal space to enter the inlet chimney sub-structure internal space; wherein with the gas thruster provided near the chimney outlet, it is used to drive a part of the hot gas in the outlet chimney substructure internal space to enter the pole internal space.

Compared with the above in the prior art, the present invention provides a street light for allowing an electronic device installed therein to work properly. The street light has an internal chimney structure for dissipating heat from the electronic device and preventing any liquid from flowing into a space where the electronic device is accommodated. This allows the street light to internally provide both a dry environment and a heat dissipation mechanism for the electronic device, without closing an internal space of the street light, so as to greatly improve the above undesirable structural drawbacks of the conventional street light.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
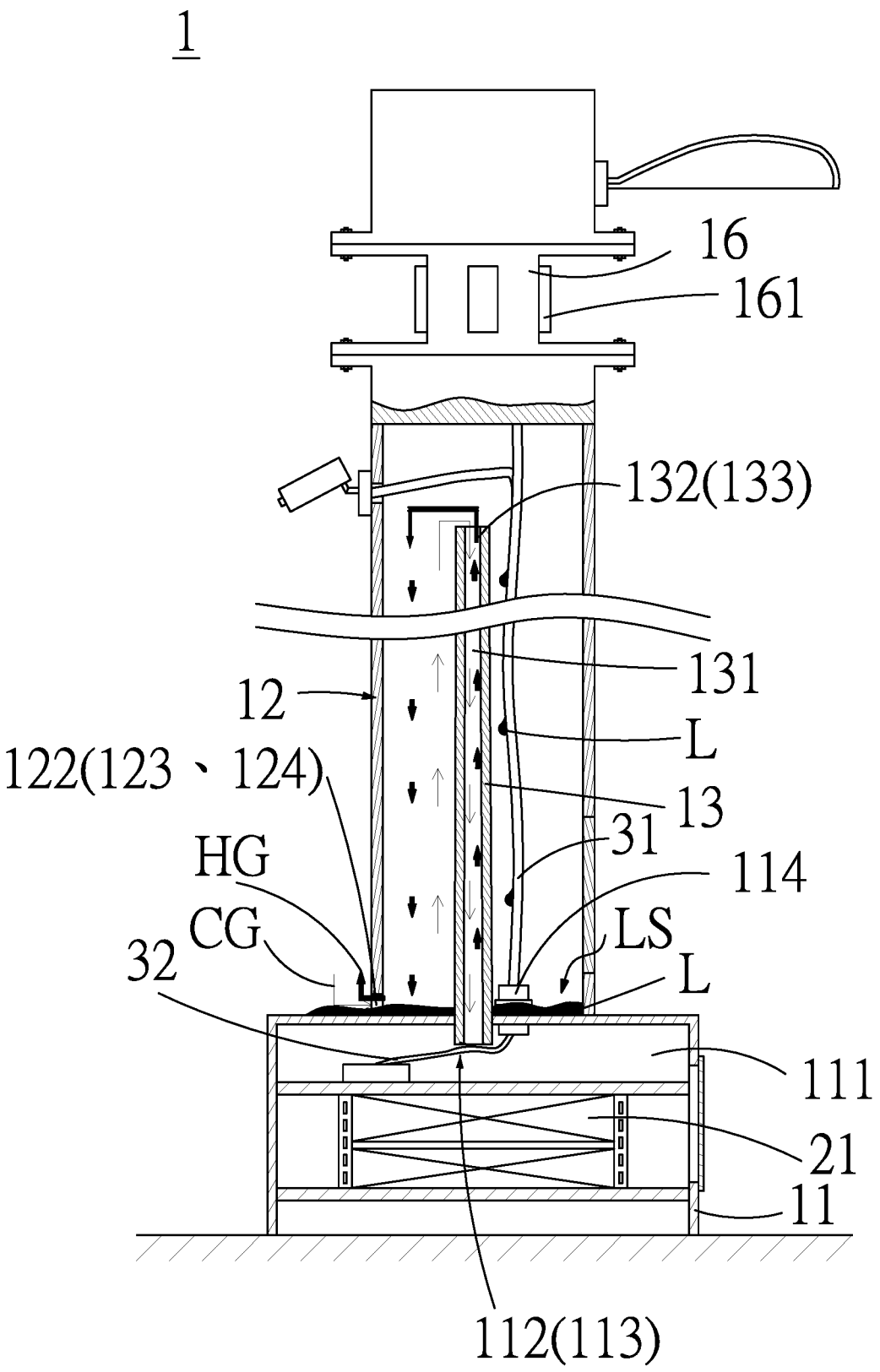
FIG. 1 is a schematic diagram of a street light according to the first preferred embodiment of the present invention.

Embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like components.

Technical features of a street light according to the present invention are described in accordance with the following preferred embodiments and with reference to FIGS. 1 to 10.

In order to make the disclosure more concise and easier to understand, the same or similarly functioning elements in the following embodiments will be described with the same symbols, and the description of the same or equivalent features will be omitted.

First Embodiment

Figure 2:
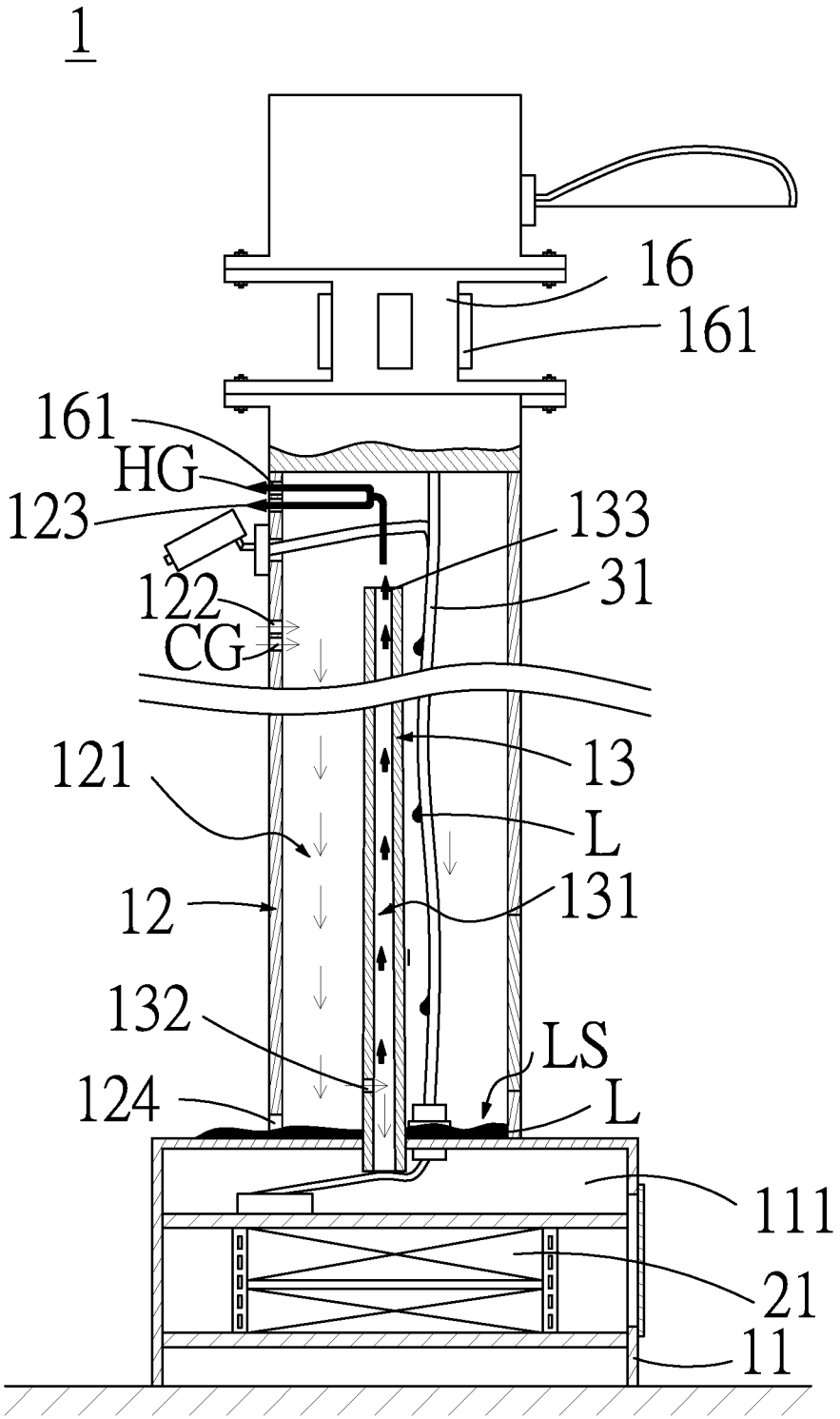
FIG. 2 is a schematic diagram of a street light according to the second preferred embodiment of the present invention.

Referring to FIGS. 1 to 2, a street light 1 according to the first embodiment includes a light base 11, a pole 12 and a chimney structure 13.

The light base 11 includes a base internal space 111, a base inlet 112 and a base outlet 113. The base internal space 111 is used to accommodate a base electronic device 21 and allow it to operate therein. The pole 12 includes a pole internal space 121, a pole inlet 122, a pole outlet 123 and a pole drain 124. The chimney structure 13 includes a chimney internal space 131, a chimney inlet 132 and a chimney outlet 133.

In this embodiment, the pole inlet 122 is used to provide gas intake for the pole internal space 121 and allow a cold gas(such as cold air) CG to be introduced to the pole internal space 121. The chimney inlet 132 is used to provide gas intake for the chimney internal space 131 and allow a part of the cold gas CG in the pole internal space 121 to be introduced to the chimney internal space 131. The base inlet 112 is used to provide gas intake for the base internal space 111 and allow a part of the cold gas CG in the chimney internal space 131 to be introduced to the base internal space 111 where the cold gas CG absorbs heat produced by the base electronic device 21 operating inside the base internal space 111 and then becomes a hot gas(such as hot air) HG with heat being dissipated from the base electronic device 21.

Moreover, the base outlet 113 is used to provide gas discharge for the base internal space 111 and allow a part of the hot gas HG to be discharged into the chimney internal space 131. Then, the chimney outlet 133, which is used to provide gas discharge for the chimney internal space 131, allows a part of the hot gas HG in the chimney internal space 131 to be exhausted into the pole internal space 121. Then, the pole outlet 123, which is used to provide gas discharge for the pole internal space 121, allows a part of the hot gas HG in the pole internal space 121 to be discharged to reduce temperature of the pole internal space 121. The chimney structure 13 thereby provides a heat dissipation mechanism for the base electronic device 21 operating within the street light, without having to seal an internal space of the street light. It should be noted that said gas is such as air.

As shown in FIG. 1, there is a liquid space LS surrounded by the light base 11, the pole 12 and the chimney structure 13. The liquid space LS is used to accommodate a liquid L in the pole internal space 121. The pole drain 124 is connected to the liquid space LS, and is used for liquid discharge from the pole internal space 121 to drain off the liquid L from the liquid space LS and prevent it from entering the chimney structure 13 and then the base internal space 111 where the base electronic device 21 is situated. This desirably avoids adverse impact on operation of the base electronic device 21 and any damage to it caused by the liquid L entering the base internal space 111. Thus, the street light 1 in this embodiment can provide a dry environment favorable for the base electronic device 21 operating inside the street light, without having to seal the internal space of the street light.

Advantageously, the chimney structure 13 formed in the pole internal space 121 not only allows heat dissipation from the base electronic device 21 but also prevents the liquid L from flowing into the base internal space 111 where the base electronic device 21 is received.

Moreover, the pole drain 124 is located actually lower than the chimney inlet 132 or the chimney outlet 133 to prevent the liquid L in the liquid space LS from reaching the chimney inlet 132 or the chimney outlet 133, so as not to allow any part of the liquid L to enter the base internal space 111 through the chimney internal space 131 and impair operation of the base electronic device 21 or even damage the base electronic device 21.

Hot gas rises while cold gas sinks. In this embodiment, the pole outlet 123 as shown in FIG. 2 is located actually higher than the chimney outlet 133 and can receive a part of the hot gas HG discharged from the chimney outlet 133. The pole outlet 123 is located actually higher than the pole inlet 122, such that the pole inlet 122 makes a part of the cold gas CG able to smoothly enter the pole internal space 121, and the pole outlet 123 allows a part of the hot gas HG in the pole internal space 121 to be exhausted smoothly. The chimney outlet 133 is located actually higher than the chimney inlet 132, such that the chimney inlet 132 allows a part of the cold gas CG in the pole internal space 121 to smoothly enter the chimney internal space 131, and the chimney outlet 133 is able to smoothly let a part of the hot gas HG in the chimney internal space 131 out.

It should be noted that the present invention is not limited to the above arrangement. In this embodiment, alternatively, as shown in FIG. 1, the base inlet 112 and the base outlet 113 can selectively be combined as a single opening, or even, the pole drain 124, the pole inlet 122 and the pole outlet 123 can selectively be combined as a single opening. Further, the chimney inlet 132 and the chimney outlet 133 can selectively be combined as a single opening.

In this embodiment, further referring to FIG. 1, the light base 11 can additionally be formed with at least one waterproof connector 114 for providing waterproof protection without having the liquid L flow into the base internal space 111 where the base electronic device 21 is received. The waterproof connector 114 is also used to connect a pole wire 31 in the pole internal space 121 to a base wire 32 in the base internal space 111, allowing light signals or electric signals to be transmitted by the pole wire 31 and the base wire 32.

In response to smart city development, at least one antenna base 16 including an antenna 161 can selectively be installed on the pole 12, for sending and receiving wireless signals for use in operation of the base electronic device 21. The antenna base 16 is detachably mounted on the pole 12 in favor of later replacement or maintenance. Alternatively, the pole 12 can selectively be installed with a plurality of antenna bases 16 such as 4G antenna, 5G antenna or microwave antenna. 5G antenna frequency spectrum can be FR1 (generally called Sub-6) spanning 450 to 6000 MHz, and FR2 (generally called millimeter-wave wireless signals) spanning 24250 to 52600 MHz.

Figure 8:
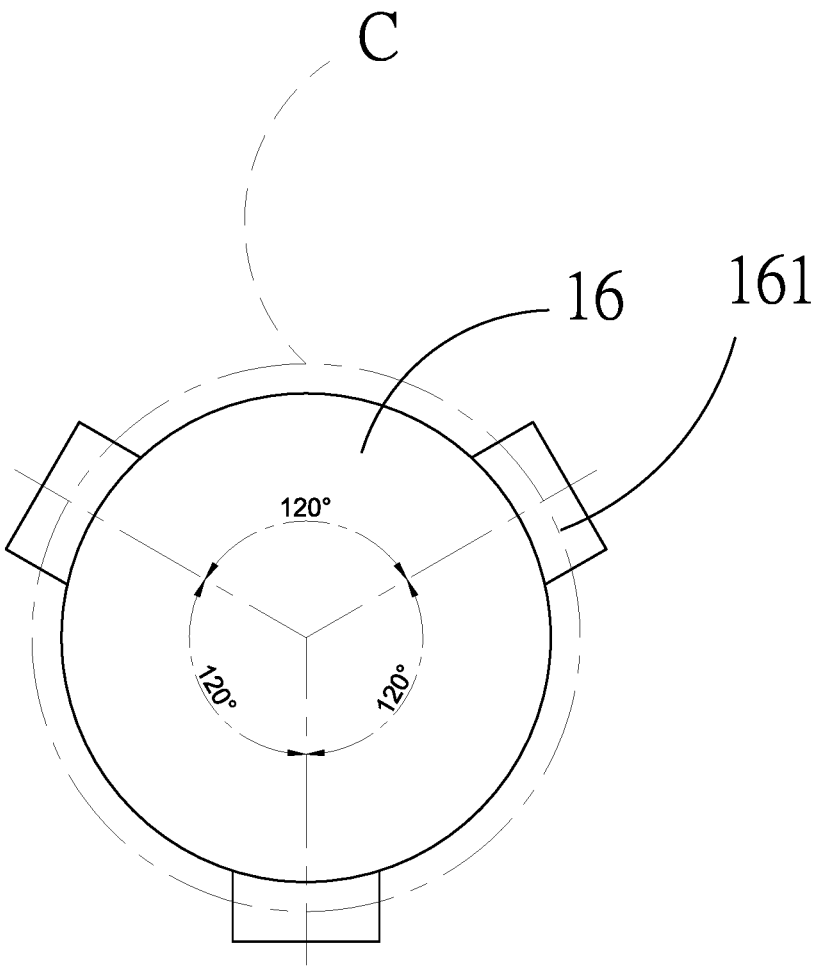
FIG. 8 is a schematic diagram of an antenna base of the street light according to the first preferred embodiment of the present invention.
Figure 9:
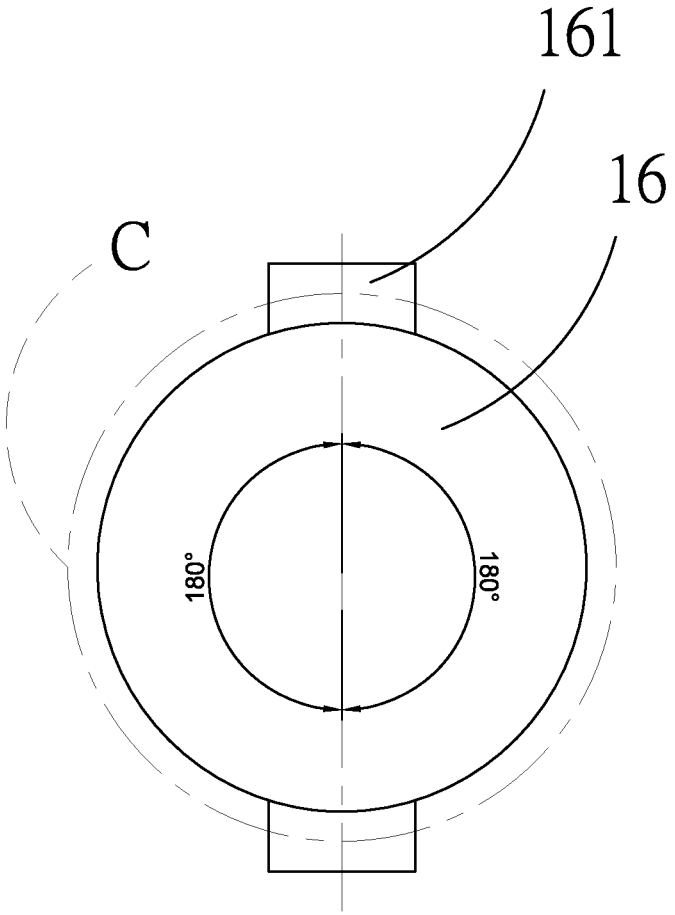
FIG. 9 is a schematic diagram of an antenna base of the street light according to the second preferred embodiment of the present invention.

Moreover, as shown in FIGS. 8 to 9, a plurality of antennas 161 can be formed on the antenna base 16. They are separately placed in a manner that, for example, they are situated on an imaginary circle with a predetermined central angle interval between any two adjacent antennas 161. In FIG. 8, the predetermined central angle is substantially 120 degrees; in FIG. 9, the predetermined central angle is substantially 180 degrees; it should be noted that the predetermined angle is not limited to such arrangements but is adjustable for achieving expected wireless signal sending and receiving.

Figure 10:
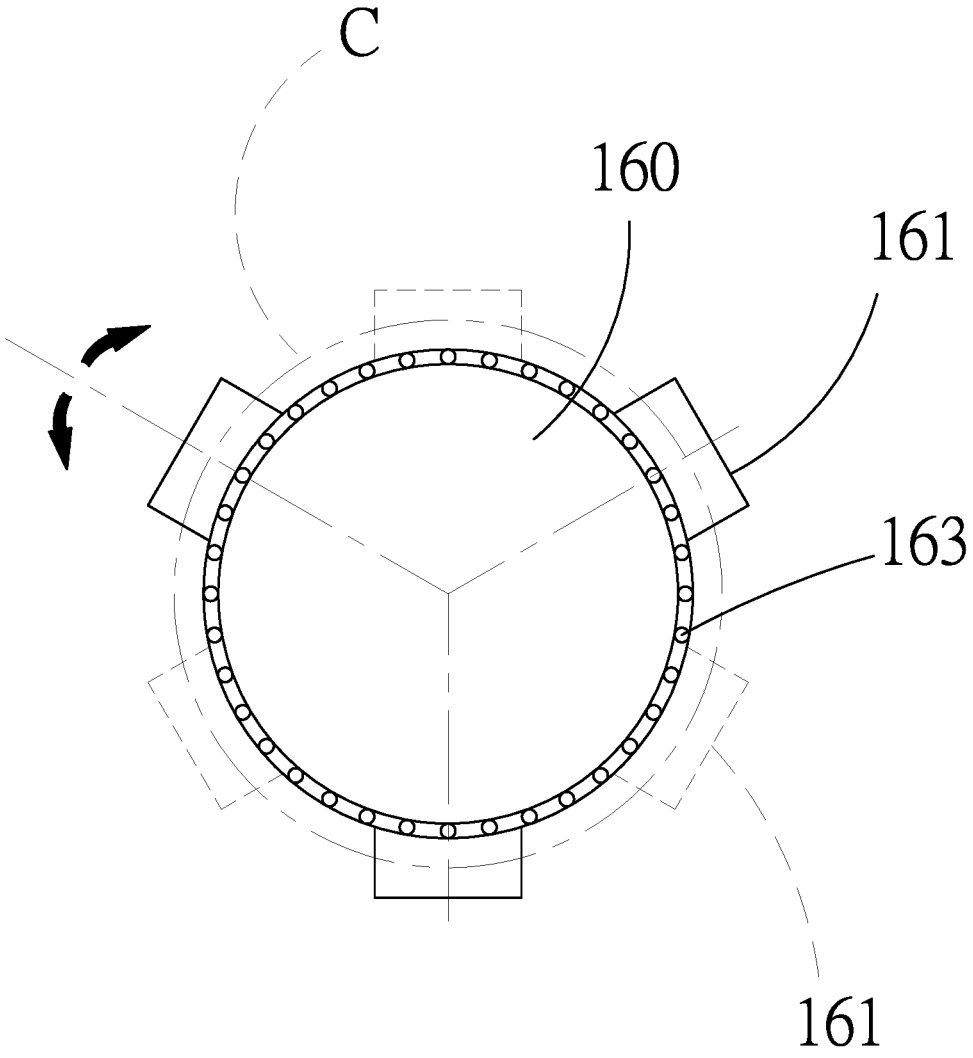
FIG. 10 is a schematic diagram of an antenna base of the street light according to the third preferred embodiment of the present invention.

Preferably, as shown in FIG. 10, the antenna base 16 includes an antenna base body 160 and a rotation structure 163. The antennas 161 are mounted at the rotation structure 163 that allows the antennas 161 to rotate in relation to the antenna base body 160 clockwise or anticlockwise within a predetermined angle range, so as to be able to adjust their direction and position for wireless signal sending and receiving in response to changes of the surroundings.

Second Embodiment

Figure 3:
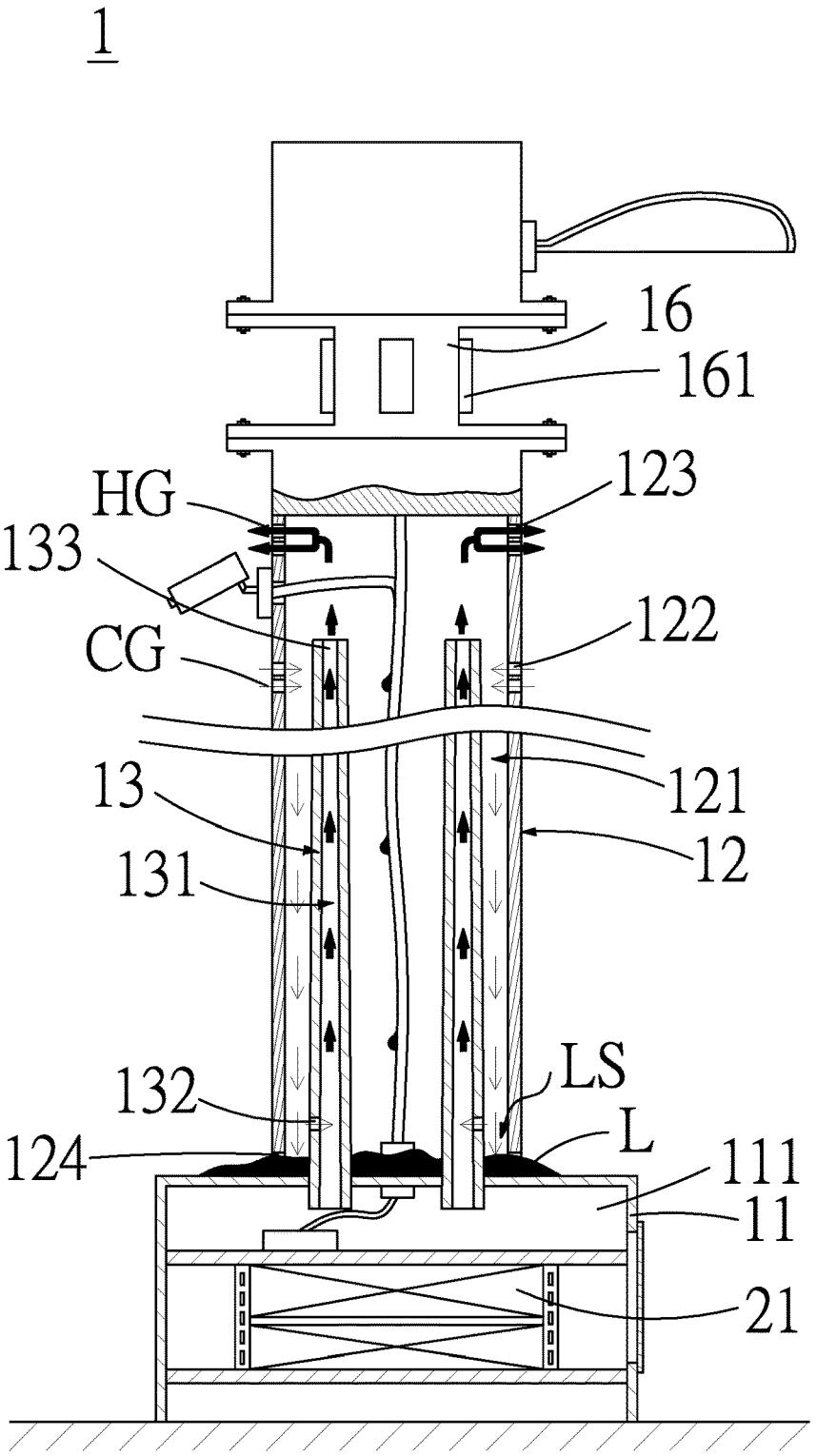
FIG. 3 is a schematic diagram of a street light according to the third preferred embodiment of the present invention.
Figure 4:
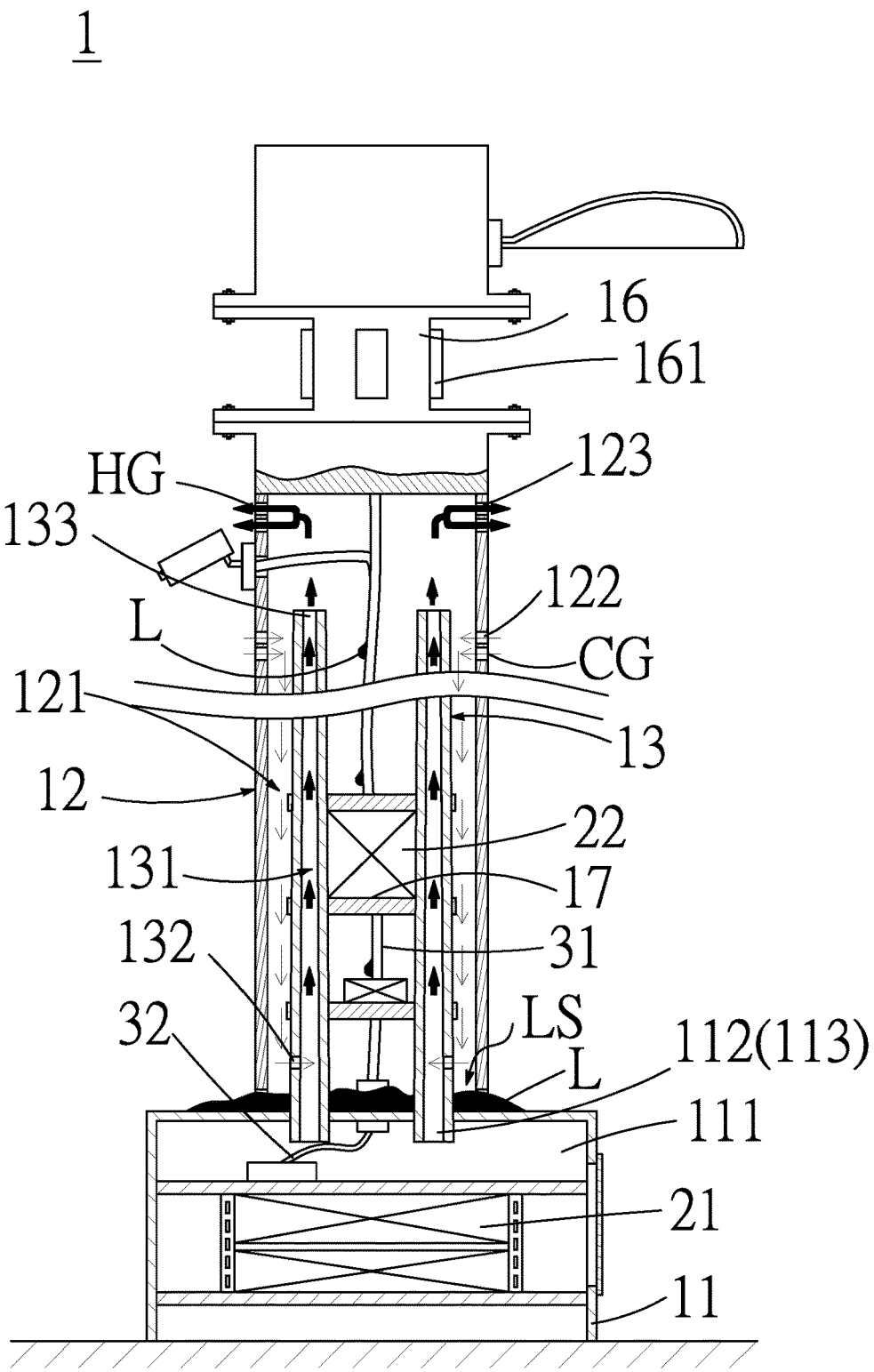
FIG. 4 is a schematic diagram of a street light according to preferred the fourth embodiments of the present invention.
Figure 5:
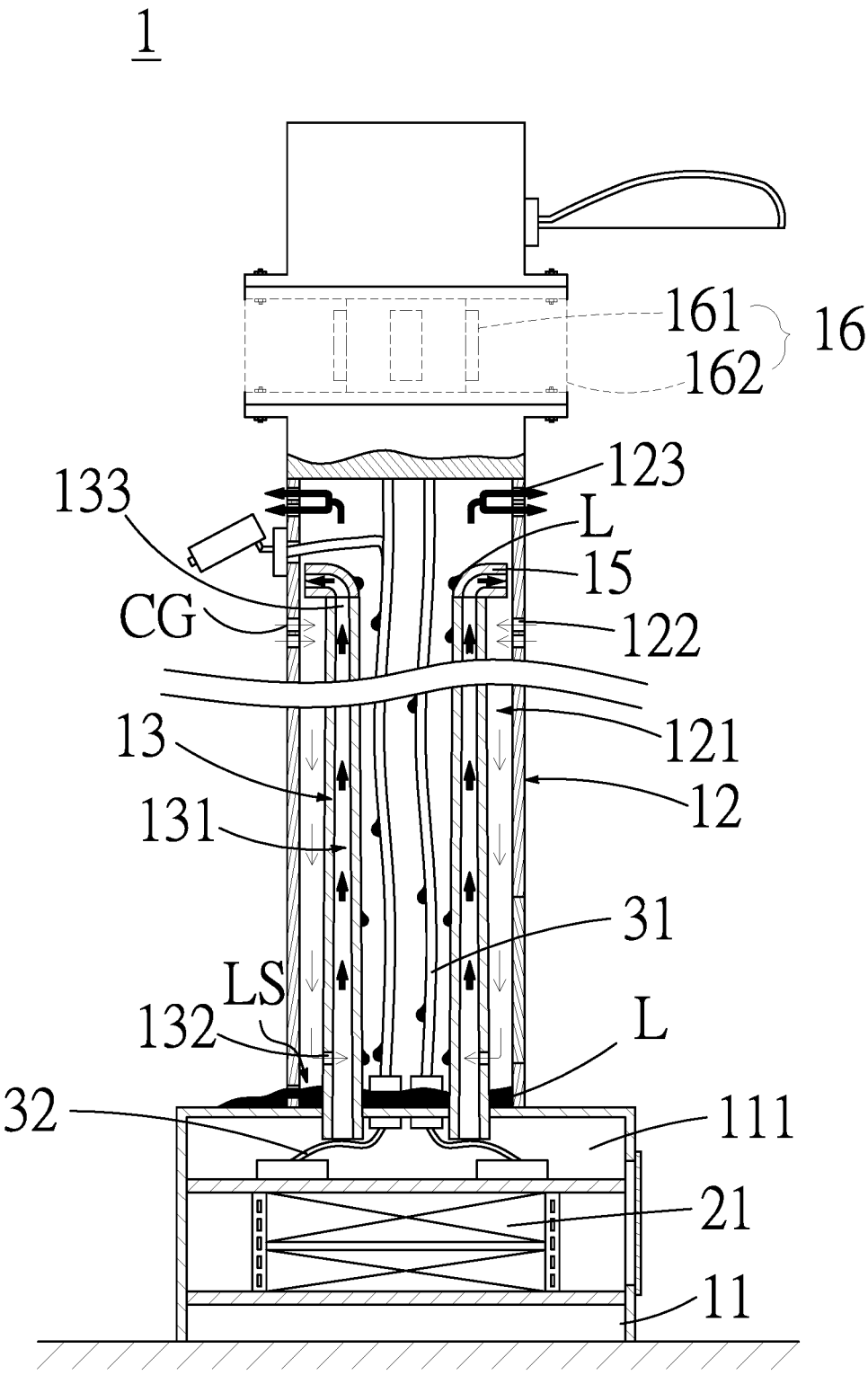
FIG. 5 is a schematic diagram of a street light according to preferred the fourth embodiment of the present invention.

As shown in FIGS. 3 to 5, the second embodiment is very similar to the above first embodiment, with a primary difference in that, the street light 1 in this embodiment is provided with a plurality of chimney structures 13 for more effectively allowing a part of the cold gas CG to be introduced to the base internal space 111 and a part of the hot gas HG to be exhausted from the base internal space 111 so as to accomplish heat dissipation for the base electronic device 21.

In this embodiment, as shown in FIG. 4, it should be noted that the street light 1 can selectively be provided with a carrier 17 for carrying a pole electronic device 22 that can thus operate inside the street light 1. The carrier 17 is placed at a predetermined position in the pole internal space 121 by means of the chimney structure 13.

In this embodiment, the antenna base 16 can selectively be formed with a cover 162 for covering the antenna 161. The cover 162 can be made of PTFE (polytetrafluoroethylene) or PE (polyethylene) to allow transmission of millimeter-wave wireless signals of the antenna 161 through the cover 162.

Moreover, as shown in FIG. 5, there is a guiding structure 15 provided near the chimney outlet 133, for guiding the liquid L around the chimney outlet 133 to leave the chimney outlet 133 and preventing it from entering the base internal space 111 through the chimney outlet 133. Alternatively, the guiding structure 15 can be provided near the chimney inlet 132, for guiding the liquid L around the chimney inlet 132 to leave the chimney inlet 132 and preventing it from entering the base internal space 111 through the chimney inlet 132. The guiding structure 15 advantageously stops the liquid L flowing into the base internal space 111 through the chimney inlet 132 or the chimney outlet 133, and thereby protects the base electronic device 21 against impaired operation or damage.

Third Embodiment

Figure 6:
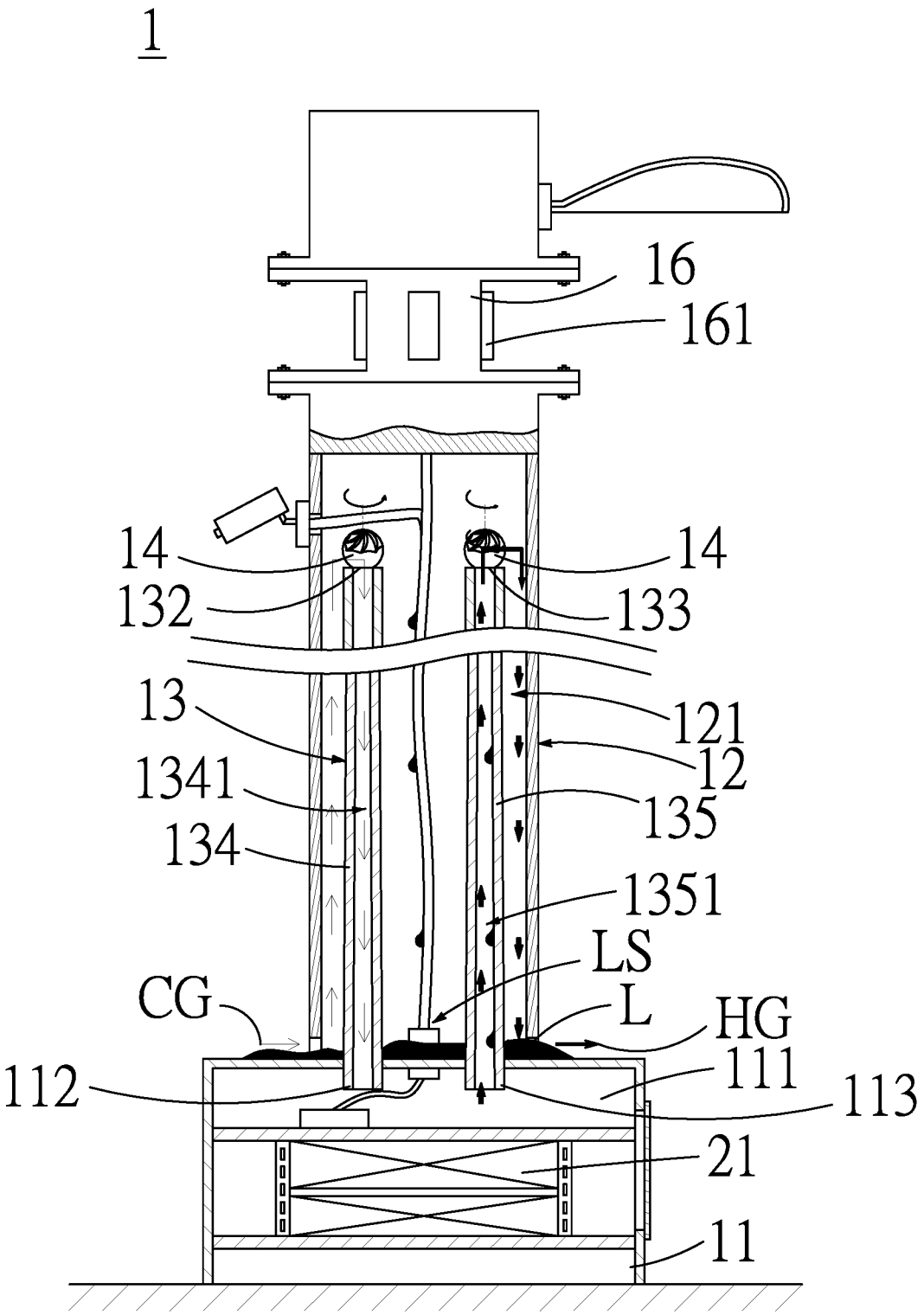
FIG. 6 is a schematic diagram of a street light according to the fifth preferred embodiment of the present invention.
Figure 7:
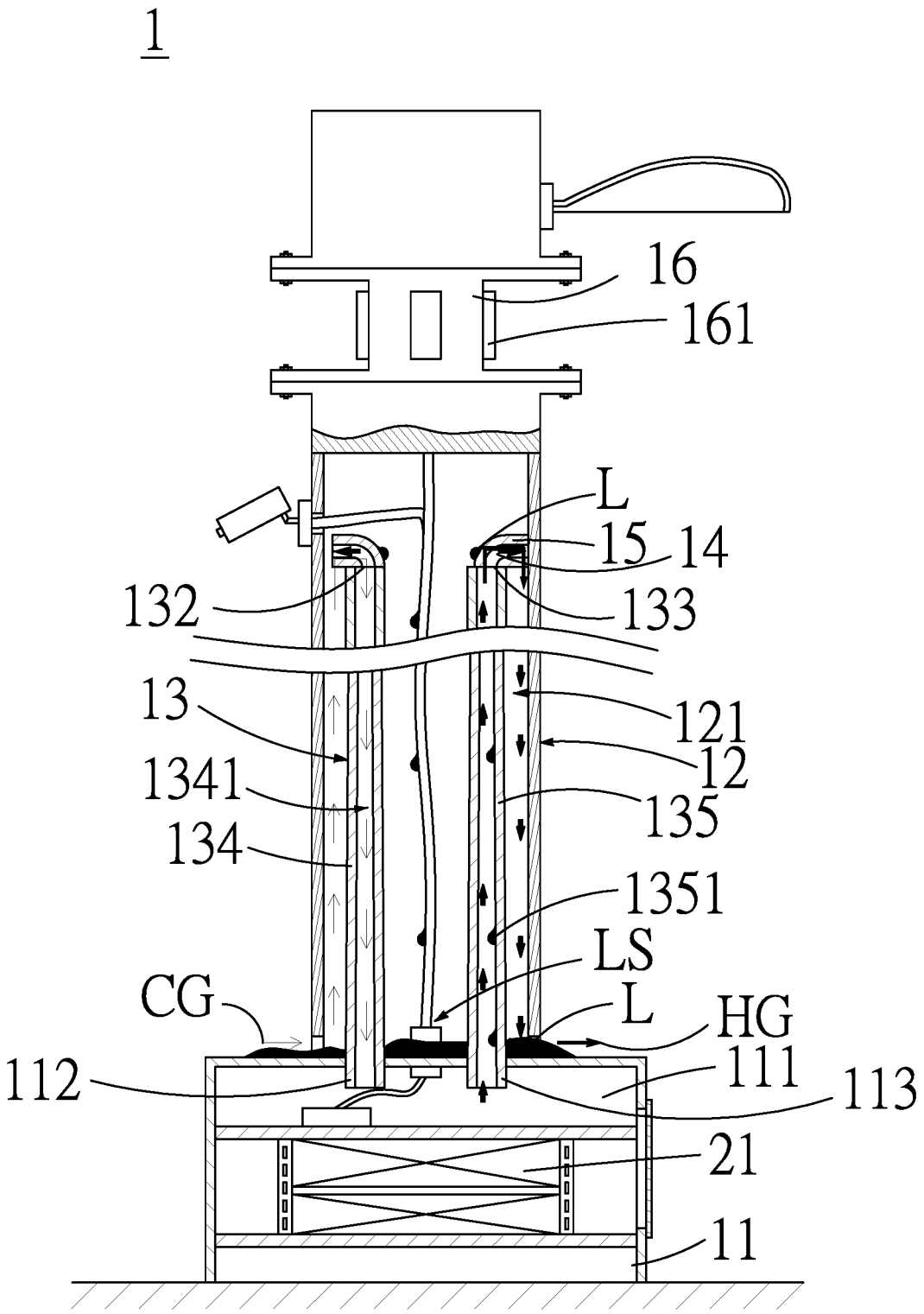
FIG. 7 is a schematic diagram of a street light according to the sixth preferred embodiment of the present invention.

As shown in FIGS. 6 to 7, the third embodiment is very similar to the above embodiments, with a primary difference in that, the chimney structure 13 in this embodiment includes an inlet chimney sub-structure 134 and an outlet chimney sub-structure 135, and the liquid space LS is surrounded by the light base 11, the pole 12, the inlet chimney sub-structure 134 and the outlet chimney sub-structure 135. The inlet chimney substructure 134 and the outlet chimney sub-structure 135 are both provided in the pole internal space 121, wherein the inlet chimney sub-structure 134 includes an inlet chimney sub-structure internal space 1341, and the outlet chimney sub-structure 135 includes an outlet chimney sub-structure internal space 1351. In this embodiment, the chimney inlet 132 is situated at the inlet chimney sub-structure 134, and the chimney outlet 133 is situated at the outlet chimney sub-structure 135.

The chimney inlet 132 is used to introduce a part of the cold gas CG in the pole internal space 121 to the inlet chimney sub-structure internal space 1341, and then a part of the cold gas CG in the inlet chimney substructure internal space 1341 would enter the base internal space 111 through the base inlet 112, so as to dissipate heat from the base electronic device 21. Moreover, the base outlet 113 is used to discharge a part of the hot gas HG in the base internal space 111 into the outlet chimney sub-structure internal space 1351, and a part of the hot gas HG in the outlet chimney sub-structure internal space 1351 is then exhausted into the pole internal space 121 through the chimney outlet 133.

In order to make the cold gas CG in the pole internal space 121 smoothly enter the chimney internal space 131, as shown in FIG. 6, there can further be formed a gas thruster 14 near the chimney inlet 132, for driving a part of the cold gas CG in the pole internal space 121 to enter the inlet chimney sub-structure internal space 1341.

Moreover, in order to make the hot gas HG in the chimney internal space 131 smoothly enter the pole internal space 121, there can further be formed a gas thruster 14 near the chimney outlet 133, for driving a part of the hot gas HG in the outlet chimney sub-structure internal space 1351 to enter the pole internal space 121.

In summary, the street light which is provided in the invention allows an electronic device installed therein to work properly. The street light has an internal chimney structure for dissipating heat from the electronic device and preventing any liquid from flowing into a space where the electronic device is accommodated. This allows the street light to internally provide both a dry environment and a heat dissipation mechanism for the electronic device, without closing an internal space of the street light, so as to greatly improve the above undesirable structural drawbacks of the conventional street light.

What is claimed is:

1. A street light for allowing a base electronic device to operate therein, for using a cold gas to dissipate heat from the base electronic device and for removing a liquid inside the street light, the street light including:

a light base including a base internal space, a base inlet and a base outlet, wherein the base electronic device is received in the base internal space;

a pole including a pole internal space, a pole inlet, a pole outlet and a pole drain; and a chimney structure formed in the pole internal space, and including a chimney internal space, a chimney inlet and a chimney outlet; wherein, the pole inlet is used to introduce the cold gas to the pole internal space;

the chimney inlet is used to introduce a part of the cold gas in the pole internal space to the chimney internal space;

the base inlet is used to introduce a part of the cold gas in the chimney internal space to the base internal space, allowing the cold gas to absorb heat produced by operation of the base electronic device to form a hot gas;

the base outlet is used to discharge a part of the hot gas in the base internal space into the chimney internal space;

the chimney outlet is used to discharge a part of the hot gas in the chimney internal space into the pole internal space;

the pole outlet is used to discharge a part of the hot gas from the pole internal space to achieve heat dissipation;

there is formed a liquid space surrounded by the light base, the pole and the chimney structure to receive the liquid; and the pole drain is connected to the liquid space to remove the liquid received in the liquid space so as to prevent the liquid from entering the base internal space through the chimney structure and affecting operation of the base electronic device.

2. The street light according to claim 1, further including an antenna base detachably mounted on the pole, wherein the antenna base has at least one antenna for sending and receiving wireless signals for use in operation of the base electronic device.

3. The street light according to claim 2, wherein the antenna base has a plurality of antennas separately provided on an imaginary circle with a predetermined central angle interval between any two adjacent ones of the plurality of antennas, wherein the predetermined central angle is substantially 120 degrees or 180 degrees.

4. The street light according to claim 2, wherein the antenna base further includes an antenna base body and a rotation structure, wherein the antenna is mounted at the rotation structure that allows the antenna to rotate in relation to the antenna base body to adjust its direction and position for wireless signal sending and receiving.

5. The street light according to claim 2, wherein the antenna base further includes a cover for covering the antenna.

6. The street light according to claim 5, wherein the cover is made of PTFE or PE for allowing transmission of millimeter-wave wireless signals of the antenna through the cover.

7. The street light according to claim 1, wherein the pole outlet is located substantially higher than the pole inlet, and the chimney outlet is located substantially higher than the chimney inlet.

8. The street light according to claim 1, wherein the pole outlet is located substantially higher than the chimney outlet to receive a part of the hot gas discharged from the chimney outlet.

9. The street light according to claim 1, wherein the base inlet and the base outlet are combined as a single opening, and the chimney inlet and the chimney outlet are combined as a single opening.

10. The street light according to claim 1, wherein the pole inlet is located substantially lower than the chimney inlet or the chimney outlet to prevent the liquid in the liquid space from reaching the chimney inlet or the chimney outlet, so as to stop the liquid entering the base internal space through the chimney internal space and affecting operation of the base electronic device.

11. The street light according to claim 1, wherein the pole drain, the pole inlet and the pole outlet are combined as a single opening.

12. The street light according to claim 1, wherein the light base further includes at least one waterproof connector for providing waterproof protection to prevent the liquid from flowing into the base internal space, and for connecting a pole wire in the pole internal space to a base wire in the base internal space.

13. The street light according to claim 1, further including a guiding structure provided near the chimney inlet or the chimney outlet; wherein with the guiding structure provided near the chimney inlet, it is used to guide the liquid around the chimney inlet to leave the chimney inlet so as to prevent the liquid from entering the base internal space through the chimney inlet and impairing operation of the base electronic device; wherein with guiding structure provided near the chimney outlet, it is used to guide the liquid around the chimney outlet to leave the chimney outlet so as to prevent the liquid from entering the base internal space through the chimney outlet and impairing operation of the base electronic device.

14. The street light according to claim 1, further for allowing a pole electronic device to operate therein, and further including a carrier for carrying the pole electronic device, wherein the carrier is mounted at a predetermined position in the pole internal space by means of the chimney structure.

15. A street light for allowing a base electronic device to operate therein, for using a cold gas to dissipate heat from the base electronic device and for removing a liquid inside the street light, the street light including:

a light base including a base internal space, a base inlet and a base outlet, wherein the base electronic device is received in the base internal space;

a pole including a pole internal space, a pole inlet, a pole outlet and a pole drain; and a chimney structure including an inlet chimney sub-structure and an outlet chimney sub-structure, wherein the inlet chimney sub-structure is provided in the pole internal space, and includes an inlet chimney sub-structure internal space and a chimney inlet; and wherein the outlet chimney sub-structure is provided in the pole internal space, and includes an outlet chimney sub-structure internal space and a chimney outlet; wherein, the pole inlet is used to introduce the cold gas to the pole internal space;

the chimney inlet is used to introduce a part of the cold gas in the pole internal space to the inlet chimney sub-structure internal space;

the base inlet is used to introduce a part of the cold gas in the inlet chimney sub-structure internal space to the base internal space, allowing the cold gas to absorb heat produced by operation of the base electronic device to form a hot gas;

the base outlet is used to discharge a part of the hot gas in the base internal space into the outlet chimney sub-structure internal space;

the chimney outlet is used to discharge a part of the hot gas in the outlet chimney sub-structure internal space into the pole internal space;

the pole outlet is used to discharge a part of the hot gas from the pole internal space to achieve heat dissipation;

there is formed a liquid space surrounded by the light base, the pole, the inlet chimney sub-structure and the outlet chimney sub-structure to receive the liquid; and the pole drain is connected to the liquid space to remove the liquid received in the liquid space so as to prevent the liquid from entering the base internal space through the chimney structure and affecting operation of the base electronic device.

16. The street light according to claim 15, further including a gas thruster provided near the chimney inlet or the chimney outlet; wherein with the gas thruster provided near the chimney inlet, it is used to drive a part of the cold gas in the pole internal space to enter the inlet chimney sub-structure internal space; wherein with the gas thruster provided near the chimney outlet, it is used to drive a part of the hot gas in the outlet chimney substructure internal space to enter the pole internal space.

* * * * *